United States Patent [19]

Leonard et al.

[11] Patent Number: 4,668,539

[45] Date of Patent: May 26, 1987

[54] PROCESS FOR THE PRESERVATION OF WOOD PRODUCTS

[75] Inventors: Robert E. Leonard; William H. Lamansky, both of Oklahoma City, Okla.

[73] Assignee: Kerr-McGee Chemical Corporation, Oklahoma City, Okla.

[21] Appl. No.: 814,253

[22] Filed: Dec. 30, 1985

[51] Int. Cl.[4] ..... B27K 3/02; B05D 1/18

[52] U.S. Cl. ..... 427/298; 427/345; 427/441

[58] Field of Search ..... 427/345, 441, 351, 298

[56] References Cited

U.S. PATENT DOCUMENTS

| | | | |
|---|---|---|---|
| 247,602 | 9/1881 | Boulton | 427/441 |
| 1,756,797 | 4/1930 | Rawson | 427/441 |
| 3,874,908 | 4/1975 | Liddell | 427/345 |
| 4,343,840 | 8/1982 | Edwards et al. | 427/441 X |

OTHER PUBLICATIONS

Hunt, G. M. and Garratt, G. A., *Wood Preservation,* 1st ed., McGraw-Hill, 1938, pp. 99-100 and 123-124.

Kirk-Othmer, *Encyclopedia of Chemical Technology,* 2nd ed., John Wiley & Sons, Inc., vol. 19, 1969, p. 679.

*Primary Examiner*—Evan K. Lawrence

*Attorney, Agent, or Firm*—William G. Addison; John P. Ward

[57] ABSTRACT

The present invention relates to improvements in impregnated wood preserving processes utilizing naphthalene containing preservative agents comprising recovering that portion of the naphthalene stripped from the preservative agent during a drying phase in the process and returning said recovered naphthalene portion to the impregnation phase of said process.

8 Claims, 1 Drawing Figure

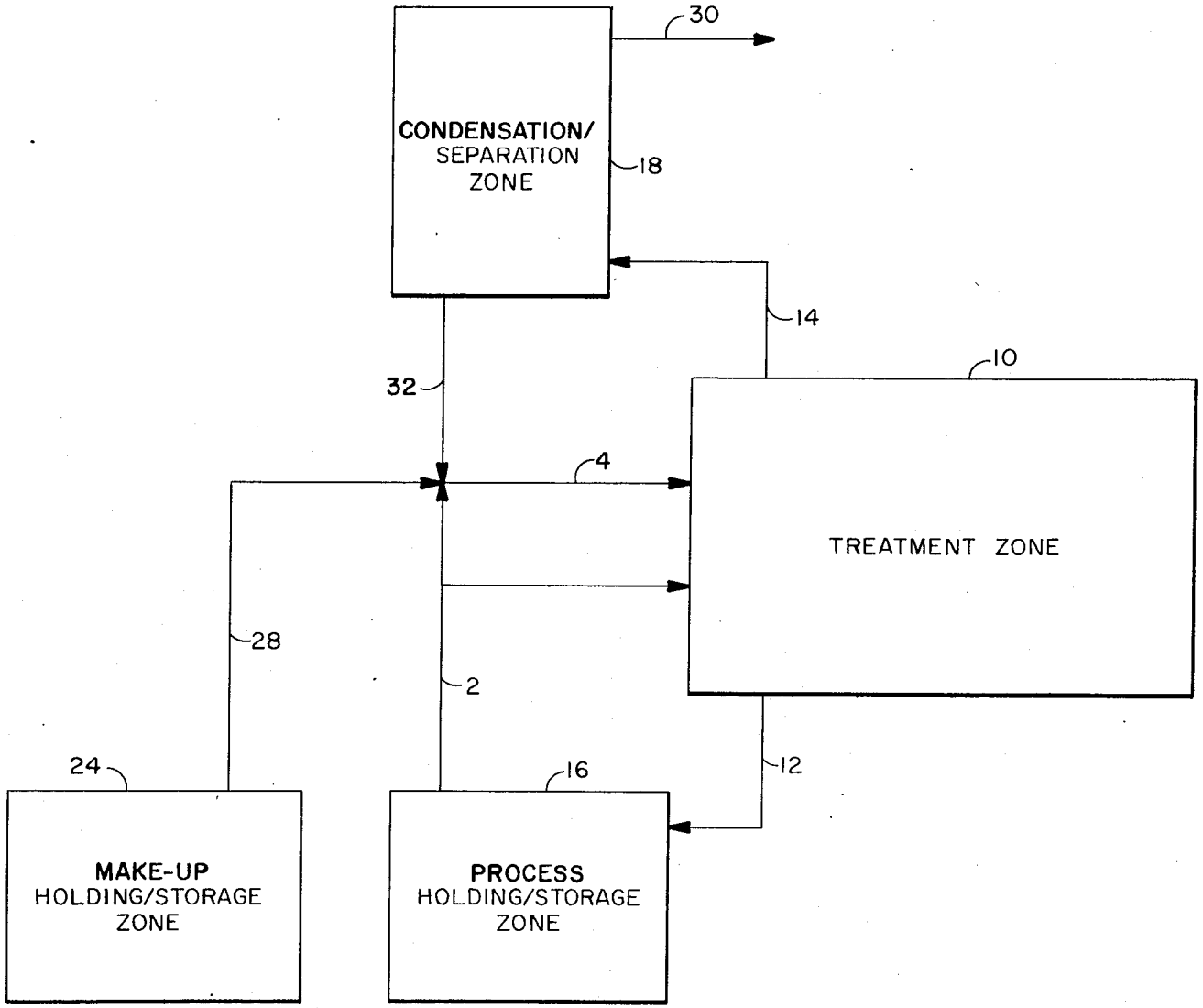
TREATMENT ZONE
10
14
12
30
18
CONDENSATION/
SEPARATION
ZONE
4
16
PROCESS
HOLDING/STORAGE
ZONE
2
32
28
MAKE-UP
HOLDING/STORAGE
ZONE
24

PROCESS FOR THE PRESERVATION OF WOOD PRODUCTS

FIELD OF THE INVENTION

The present invention relates to improvements in wood preserving processes wherein wood products are both dried and impregnated with a wood preservative agent. More particularly, the present invention relates to improvements in those wood preserving processes utilizing naphthalene containing preservative agents wherein the naphthalene is stripped from the preservative agent during the drying phase of the process.

BACKGROUND OF THE INVENTION

Integrated wood preserving processes for artificially drying wood products and subsequently impregnating the dried wood products with a preservative agent under pressure are old and well-known. One such known integrated process utilizes a boiling under a vacuum step to dry the wood products and a pressure step to thereafter force preservative agent into the cells of the dried wood products. This process has particular applicability to the drying and impregnation of wood products such as bridge ties, mine ties, railroad crossties and switch ties, pilings for both land and water use, utility poles, and the like wherein naphthalene containing creosote, creosote-coal tar and creosote-petroleum oil solutions are utilized in both the drying and the pressure steps.

In utilizing the above integrated process, the wood products to be treated first are loaded into a suitable treatment vessel known in the wood preserving art as a cylinder or retort. A preservative agent, such as one of the aforementioned naphthalene containing solutions, then is added to the treatment vessel to completely cover the wood products. Heat and vacuum then are applied to the treatment vessel to commence the drying of the wood products. Under these operating conditions water comprising the moisture inherent in the wood products continuously is boiled out of the wood products and withdrawn from the treatment vessel in the form of steam. This heat and vacuum treatment is continued until such time as a predetermined amount of water has been recovered from the treatment vessel.

Upon completion of this drying step the dried wood products then are subjected to a pressure impregnation step. For this impregnation step, the preservative agent either will be retained in the treatment vessel and a pressure applied thereto or the vessel first will be drained, pressurized to atmospheric or superatmospheric pressure, and the vessel then refilled with preservative agent. The particular impregnation procedure employed will depend upon whether the goal is to retain as much of the preservative agent in the cells of the wood products as is possible, or whether the goal merely is to coat the interior walls of the cells of said wood products. In the wood preserving art, these different impregnation procedures generally are referred to as the "full cell" process as exemplified by the known Bethel process and the "empty cell" process as exemplified by the known Lowry and Rueping processes.

Regardless of which of the above particular impregnation procedures is employed, elevated pressures are used in the treatment vessel to force the preservative agent into the wood products undergoing treatment. During this pressure step, heat also is applied to the treatment vessel to maintain the temperature of the preservative agent therein at a temperature level of approximately the same as that previously employed in the drying step. On completion of this pressure step, the treatment vessel then is drained of the preservative agent and most usually a vacuum applied to dry the surface of the wood products prior to their removal from the cylinder.

In utilizing the above integrated process for drying and impregnating wood products with one of the aforementioned naphthalene containing preservative agents problems can and do occur. These include, for example, the plugging of process equipment and the contamination of process derived waste waters with naphthalene as a result of the naphthalene being stripped from the preservative agent by the moisture removed from the wood products during the drying step. These problems further are compounded by the fact that in most commercial operations, it is usual practice to recover this naphthalene and return it to the preservative agent storage or supply tanks. Thus, with each succeeding use of the preservative agent from the storage tanks, the sample naphthalene not only is being restripped from the preservative agent during each drying phase, but also this napthalene is building up in concentration in the recycling preservative agent. Such build-up only further contributes to the aforementioned process equipment plugging and waste water contamination problems.

SUMMARY OF THE INVENTION

It now has been discovered that it is possible to substantially minimize or eliminate the above described problems of process equipment plugging, process waste water contamination and naphthalene build-up in integrated wood preserving processes through the utilization of the improvements of the present invention. The improvements of this invention particularly are applicable to those integrated wood preserving processes wherein wood preservative agents are employed to effect both the drying and the impregnation, under pressure, of wood products and wherein both a first effluent stream comprising a mixture of process derived waste water and naphthalene and a naphthalene depleted preservative agent are produced.

Broadly, the improvements comprising the present invention include the steps of recovering the first effluent stream and, thereafter, separating it into a second effluent stream comprising substantially the process derived waste water and a third effluent stream comprising naphthalene. This third effluent stream then is returned to and mixed with the naphthalene depleted preservative agent to provide a naphthalene enhanced preservative agent. In the final step of the present invention, the naphthalene enhanced preservative agent then is contacted with the dried wood products under elevated temperatures and pressures to effect absorption by the dried wood products of a portion of the naphthalene enhanced preservative agent.

DESCRIPTION OF THE DRAWING

The single FIGURE represents a schematic illustration of the general arrangement of the flow of materials in the practice of the present invention.

DETAILED DESCRIPTION OF THE INVENTION

For the following detailed description of the improvements comprising the present invention and the wood preserving processes to which they are applicable, reference is made to the single FIGURE. Referring now to the single FIGURE, the wood products (not shown) to be subjected to artificial drying and subsequent impregnation are loaded into treatment zone 10, which generally will consist of one or more sealable, elongated, cylindrical vessels commonly referred to in the wood preserving industry as cylinders or retorts. These vessels generally are equipped with internal stream coils, means for introducing and removing the preservative agents to and from the vessels and means for applying either a vacuum or elevated pressure thereto. Once the wood products have been loaded into treatment zone 10, said zone 10 is sealed and a preservative agent introduced thereto by way of communicating conduits 2 and 4 from process holding/storage zone 16. For purposes of the present invention, the preservative agent can be any naphthalene containing material selected from the group consisting of creosote, creosote-coal tar and creosote-petroleum oil solutions. The creosote, creosote-coal tar and creosote-petroleum oil solutions employed in wood preserving processes to which the improvements of the present invention are applicable are those meeting the standard specifications as set forth in ASTM designations D390-80 and D391-78 and in the American Wood-Preservers Association standard P3-67, respectively. Sufficient quantities of the naphthalene containing preservative agent are conveyed through communicating conduits 2 and 4 to treatment zone 10 to completely cover the wood products previously loaded into treatment zone 10. Heat then is applied to the naphthalene containing preservative agent to raise the temperature of the preservative agent, as well as the wood products submerged therein, to a predetermined level. Simultaneously therewith, a vacuum is drawn on treatment zone 10 to effect a reduction in pressure therein.

The drying of the wood products contained within treatment zone 10 is carried out at temperature levels which do not exceed the maximum temperatures recommended for the particular species of wood in the wood products undergoing treatment. Also, the drying will be carried out at reduced pressure levels sufficiently intense to allow vaporization of the moisture inherent in the wood products at the temperatures employed. In general, temperatures ranging from about 175° F. (79° C.) to about 225° F. (107° C.) and reduced pressures ranging from about 20 to about 25 inches of mercury will be employed. For a more specific description of particular temperatures and vacuums which can be used for drying particular wood species, reference is made to ASTM designation D1760-83, the teachings of which are incorporated herein by reference in their entirety.

During the drying phase of the wood preserving processes to which the present invention finds applicability, the moisture inherent in the wood products undergoes vaporization and is released from the wood products in the form of steam. As this steam passes through the naphthalene containing preservative agent, it effectively strips at least a portion of the naphthalene from the preservative agent, forming a vaporous mixture of said inherent moisture and naphthalene. This vaporous mixture or first effluent stream continuously is removed from treatment zone 10 and conveyed therefrom through conduit 14 to condensation/separation zone 18. Within condensation/separation zone 18, the vaporous mixture is subjected to temperatures sufficient to cool the vaporous mixture thereby forming two separate and distinct phases within condensation/separation zone 18. These two phases include a liquid phase comprising substantially water, said water being the inherent moisture removed from the wood products, and a solid phase comprising that portion of the naphthalene stripped from the preservative agent. These liquid and solid phases are separated from each other by withdrawing the liquid phase, which constitutes a second process effluent stream, from condensation/separation zone 18 by way of conduit 30.

The solid phase of naphthalene remaining in condensation/separation zone 18 then is liquefied, forming a fluid phase of naphthalene. The liquefied naphthalene then is withdrawn from condensation/separation zone 18 by way of conduit 32 as a third effluent stream. Any means for liquefying solids can be employed for liquefying this solid phase of naphthalene. Such means can include, for example, the use of a suitable solvent to effect dissolution of the solid phase including the use of the wood preservative agents themselves as solvents, the use of heating to melt the solid phase, and the like. The most efficient and economic means for liquefying the solid phase of naphthalene is the use of heat. Thus, in a preferred embodiment, condensation/separation zone 18 will be heated to an elevated temperature sufficient to effect a melting of said solid phase into a fluid phase of naphthalene. The elevated temperature to which condensation/separation zone 18 will be heated, will be a temperature of at least about the melting point of the solid naphthalene or about 80° C. Higher temperature can be employed if desired.

Following completion of the drying phase, and depending upon whether a "full cell" or "empty cell" treatment is to be used, the naphthalene depleted preservative agent in treatment zone 10 either will be retained in treatment zone 10 or removed therefrom through conduit 12 and conveyed to process holding/storage zone 16. If a full cell treatment is to be used, the naphthalene depleted preservative agent produced during the drying phase will be retained in treatment zone 10. Additional naphthalene containing preservative agent then will be conveyed to treatment zone 10 from make-up holding/storage zone 24. This additional naphthalene containing preservative agent is introduced into treatment zone 10 from make-up holding/storage zone 24 by way of communicating conduits 4 and 28. Sufficient quantities of this additional naphthalene containing preservative agent will be introduced into treatment zone 10 to at least maintain the dried wood products in treatment zone 10 completely submerged in the combined preservative agent during the whole of the impregnation phase.

The liquid naphthalene comprising the third effluent stream and withdrawn from condensation/separation zone 18 through conduit 32 then is introduced through conduit 4 into treatment zone 10. Within treatment zone 10, this third effluent stream mixes with the naphthalene depleted preservative agent contained therein to provide a naphthalene enhanced preservative agent. This third effluent stream of liquid naphthalene also can be mixed with the additional or make-up naphthalene containing preservative agent in a suitable mixing zone (not shown) and the resulting naphthalene enriched mixture conveyed to treatment zone 10. Generally, it will be preferred to blend the third effluent stream of liquid naphthalene with the additional or make-up naphthalene containing preservative agent to avoid any possibility of solidification of the liquid naphthalene as it is returned to treatment zone 10.

When one of the empty cell procedures is employed to pressure impregnate the dried wood products the naphthalene depleted preservation agent first is withdrawn from treatment zone 10. The withdrawn naphthalene depleted preservative agent is returned through conduit 12 to process holding/storage zone 16. Air then is introduced into treatment zone 10 through means not shown. Most usually the initial pressure employed in treatment zone 10 will be established at either atmospheric pressure (Lowry process) or some pressure above atmospheric (Rueping process) after which the naphthalene depleted preservative agent is returned to treatment zone 10 from process holding/storage zone 16.

The third effluent stream of liquid naphthalene from condensation/separation zone 18 and the additional or make-up naphthalene containing preservative agent from make-up holding/storage zone 24 also will be introduced into treatment zone 10 at this time. As in the full cell process described above, the third effluent stream of liquid naphthalene and the additional or make-up naphthalene containing preservative agent can be introduced into treatment zone 10 individually or first mixed in a suitable mixing zone (not shown) and the resulting mixture then introduced into treatment zone 10. The third effluent stream of liquid naphthalene also can be mixed with the naphthalene depleted preservative agent previously withdrawn from treatment zone 10 in either process holding/storage zone 16 or other suitable mixing zone (not shown) prior to the return of these materials back to treatment zone 10. Finally, and as illustrated in the single FIGURE, it is possible to mix the third effluent stream, the additional or make-up naphthalene containing preservative agent and the naphthalene depleted preservative agent together in a suitable mixing zone (not shown) and to introduce the resulting mixture to treatment zone 10.

Whether a full cell or empty cell technique is employed to impregnate the dried wood products, the same operating conditions of temperature and pressure generally are employed in both. Thus, irrespective of the impregnation technique used, temperatures averaging not less than about 175° F. (79° C.) and not greater than about 225° F. (107° C.) will be employed. Also irrespective of the particular impregnation technique used, pressures in the range of from about 115 psig to about 250 psig will be employed. The precise temperatures and pressures used during the impregnation phase will depend upon the particular material or species of wood undergoing treatment. In this regard, reference is made, once again, to ASTM designation D1760-83 and the teachings therein relating to impregnation temperatures and pressures and, which teachings are incorporated herein by reference in their entirety.

Following completion of the impregnation phase, the preservative agent then is withdrawn from treatment zone 10 through conduit 12 and returned to process holding/storage zone 16 for use in the subsequent drying and impregnation of further wood products.

The following example illustrates the use of the improvements of the present invention and is not intended to limit or restrict the scope of the invention in any manner.

EXAMPLE 1

Into a cylinder having inlet and outlet means for introducing and withdrawing preservative agent and for removal of process vapors is loaded approximately 7,000 cubic feet of wet oak railroad ties. Upon closure of the cylinder about 300,000 pounds of a creosote-coal tar solution and containing about 12 percent by weight or 36,000 pounds of naphthalene, then is charged to the cylinder to completely submerge the ties in the solution. The cylinder then is heated to a temperature in the range of about 175° F. to about 185° F. while maintaining the cylinder under a vacuum ranging from about 20–25 inches of mercury pressure. This vacuum is applied through a water cooled condenser connected to the outlet means provided for removal of the process vapors.

Heating under vacuum is continued for about 12 hours during which time about 2500 gallons of sap water and about 3200 pounds or about 8.9 percent by weight of the total naphthalene are recovered in the water cooled condenser connected to the cylinder. The condenser then is isolated from the cylinder and the vacuum system, brought to atmospheric pressure and heated to a temperature ranging from about 95° C. to about 100° C. to liquefy the solid naphthalene therein.

The liquid naphthalene then is withdrawn from the condenser and is pumped into a process conduit in which the naphthalene depleted creosote-coal tar solution from the cylinder is being circulated. The resulting naphthalene enhanced creosote-coal tar solution then is returned to the cylinder wherein it is maintained under a pressure of about 150 psig for a period of time sufficient to force about 36,000 pounds or about 12 percent by weight of the naphthalene enhanced creosote-coal tar solution into the dried wood ties. At the end of this period, the naphthalene enhanced creosote-coal tar solution remaining in the cylinder is pumped therefrom into a storage tank or vessel and the treated wood ties removed. The above described procedure is repeated for three additional drying/impregnation phases to treat three additional loads of wet oak railroad ties. In each subsequent phase the ties are treated with a mixture of the creosote-coal tar solution recovered at the end of the previous phase plus the amount of fresh creosote-coal tar solution required as make-up.

The following Table I contains data relating to the calculated material balance for the naphthalene in the creosote-coal tar solution over the course of the four process cycles. As can be seen from this Table I the material balance essentially is constant.

TABLE I

| Cycle No. | Naphthalene, lbs. In W.P.[1] | Distilled Out | To Wood | In Make-up |
|---|---|---|---|---|
| 1 | 36,000 | 3,200 | 4,320 | 4,320 |
| 2 | 36,000 | 3,200 | 4,320 | 4,320 |
| 3 | 36,000 | 3,200 | 4,320 | 4,320 |
| 4 | 36,000 | 3,200 | 4,320 | 4,320 |

[1]W.P. = wood preservative comprising a mixture of creosote and coal tar

EXAMPLE 2

(Comparative Example)

The procedure of Example 1 above is repeated with the exception that the naphthalene recovered in the condenser during the drying phase is recombined with the creosote-coal tar solution after completion of the impregnation phase rather than prior to commencement of this phase. The following Table II contains data relating to the calculated material balance for the naphthalene over the four process cycles. As can be seen from this Table II the naphthalene content of creosote-coal tar solution will increase over the course of these four process cycles.

TABLE II

| Cycle No. | Naphthalene, lbs. In W.P.[1] | Distilled Out | To Wood | In Make-Up |
|---|---|---|---|---|
| 1 | 36,000 | 3,200 | 3,936 | 4,320 |
| 2 | 36,384 | 3,584 | 3,936 | 4,320 |
| 3 | 36,768 | 3,968 | 3,936 | 4,320 |
| 4 | 37,152 | 4,352 | 3,936 | 4,320 |

[1]W.P. = wood preservative comprising a mixture of creosote and coal tar

A comparison of the data in Tables I and II discloses that the improvements of the present invention can provide the ability for maintaining a substantially constant concentration of naphthalene in wood preserving processes based upon the return and reuse of naphthalene containing preservative agents. This ability, through the use of the improvements of this invention to achieve such substantially constant concentration, results in substantially minimizing or eliminating the problems of process equipment plugging and waste water contamination most usually associated with these wood preserving processes.

While the present invention has been described in terms of all of its known embodiments, it is to be understood that changes and modifications can be made without departing from the spirit and scope thereof.

What is claimed is:

1. In a word preserving process wherein wood products are artificially dried by submerging the wood products in a naphthalene containing preservative agent in a treatment zone and wherein said treatment zone is maintained at an elevated temperature and reduced pressure to effect removal of a first effluent stream of a vaporous mixture of a portion of water inherent in said wood products and a portion of the naphthalene in said preservative agent from said treatment zone and to provide water depleted wood products and a naphthalene depleted preservative agent and wherein said water depleted wood products then are contacted withe said naphthalene depleted preservative agent in said treatment zone while maintaining said treatment zone at an elevated temperature and elevated pressure to effect absorption by the water depleted wood products of a portion of the naphthalene depleted preservative agent, the improvements which comprise the steps of:

recovering said vaporous mixture of the portion of the water inherent in said wood products and the portion of the naphthalene from said preservative agent removed from said treatment zone;

separating said mixture into a second effluent stream comprising substantially said water and a third effluent stream comprising said naphthalene;

mixing said third effluent steam comprising said naphthalene with said naphthalene depleted preservative agent to provide a naphthalene enhanced preservative agent; and contacting said water depleted wood products with said naphthalene enhanced preservative agent in said treatment zone under said elevated temperatures and said elevated pressures to effect absorption by the water depleted wood products of a portion of said naphthalene enhanced preservative agent.

2. The improvements of claim 1 wherein the step of recovering said vaporous mixture of the portion of the water inherent in said wood products and the portion of the naphthalene from said preservative agent removed from said treatment zone further is defined as comprising the steps of:

withdrawing said mixture from said treatment zone in the form of steam; and introducing said steam into a condensation zone maintained at a temperature wherein said stream is condensed to form a liquid phase comprising substantially water and a solid phase comprising naphthalene.

3. The improvements of claim 2 wherein the step of separating said mixture into a second effluent stream comprising substantially said water and a third effluent stream comprising said naphthalene further is defined as comprising the steps of:

withdrawing said second effluent stream comprising substantially said water from said condensation zone and leaving said solid phase comprising said naphthalene in said condensation zone;

liquefying said solid phase comprising said naphthalene to provide a fluid phase of said naphthalene; and withdrawing said fluid phase of said naphthalene from said condensation zone and fluid phase of said naphthalene comprising said third effluent stream.

4. The improvements of claim 3 wherein the step of liquefying said solid phase comprising said naphthalene further is defined as comprising the step of:

heating said condensation zone to an elevated temperature sufficient to melt said solid phase comprising said naphthalene and provide said fluid phase of said naphthalene.

5. The improvements of claim 3 wherein the liquefying of said solid phase comprising said naphthalene further is defined as comprising the step of:

introducing into said condensation zone, a liquefying solvent capable of dissolving said solid phase comprising said naphthalene and thereby provide a fluid phase of said naphthalene and said solvent.

6. The improvements of claim 5 wherein said liquefying solvent is a wood preservative agent selected from the group consisting of creosote, creosote-coal tar and creosote-petroleum oil solutions.

7. The improvements of claim 1 wherein the step of mixing said third effluent stream comprising said naphthalene with said naphthalene depleted preservative agent to provide a naphthalene enhanced preservative agent further is defined as comprising the steps of:

withdrawing said naphthalene depleted preservative agent from said treatment zone; and mixing said third effluent stream comprising said naphthalene with said naphthalene depleted preservative agent to provide said naphthalene enhanced preservative agent.

8. The improvements of claim 4 wherein the step of contacting said water depleted wood products with said naphthalene enhanced preservative agent in said treatment zone further is defined as comprising the steps of:

introducing said naphthalene enhanced preservative agent into said treatment zone containing said water depleted wood products; and maintaining said treatment zone at an elevated temperature and elevated pressure to effect absorption by the water depleted wood products of a portion of the naphthalene enhanced preservative agent.

* * * * *